US008317069B2

(12) United States Patent
Zhang et al.

(10) Patent No.: US 8,317,069 B2
(45) Date of Patent: Nov. 27, 2012

(54) PNEUMATIC NAILER WITH SLEEVE ACTUATED PISTON RETURN

(75) Inventors: Yizhuo Zhang, Arlington Heights, IL (US); Marco Laubach, Wheeling, IL (US)

(73) Assignee: Robert Bosch GmbH, Stuttgart (DE)

( * ) Notice: Subject to any disclaimer, the term of this patent is extended or adjusted under 35 U.S.C. 154(b) by 384 days.

(21) Appl. No.: 12/701,899

(22) Filed: Feb. 8, 2010

(65) Prior Publication Data

US 2011/0192879 A1 Aug. 11, 2011

(51) Int. Cl.
*B25C 1/04* (2006.01)

(52) U.S. Cl. ..... 227/130; 227/156

(58) Field of Classification Search ..... 227/130, 227/156

See application file for complete search history.

(56) References Cited

U.S. PATENT DOCUMENTS

| | | | | |
|---|---|---|---|---|
| 3,715,069 | A | 2/1973 | O'Connor | |
| 3,893,610 | A | 7/1975 | Smith | |
| 3,895,562 | A | 7/1975 | El Guindy | |
| 4,030,655 | A | 6/1977 | Rothfuss et al. | |
| 4,436,237 | A * | 3/1984 | Vornberger et al. | 227/130 |
| 5,873,510 | A | 2/1999 | Hirai et al. | |
| 6,648,202 | B2 * | 11/2003 | Miller et al. | 227/130 |
| 6,783,050 | B2 * | 8/2004 | Ishizawa et al. | 227/130 |
| 7,185,712 | B2 * | 3/2007 | Miller et al. | 173/1 |
| 7,225,768 | B2 * | 6/2007 | Akiba et al. | 123/46 SC |
| 7,290,691 | B1 | 11/2007 | Wen | |
| 7,296,721 | B1 * | 11/2007 | Wen | 227/130 |
| 7,341,174 | B1 | 3/2008 | Wen | |
| 7,395,954 | B2 | 7/2008 | Wen | |
| 7,448,524 | B1 | 11/2008 | Liang et al. | |
| 2006/0157528 | A1 * | 7/2006 | Osuga et al. | 227/130 |
| 2008/0006670 | A1 * | 1/2008 | Wen | 227/130 |
| 2008/0105728 | A1 | 5/2008 | Wen | |
| 2009/0057365 | A1 * | 3/2009 | Murayama et al. | 227/10 |

OTHER PUBLICATIONS

PCT Search Report in corresponding PCT Application (i.e., PCT/US2011/023457), mailed May 13, 2011 (4 pages).

* cited by examiner

*Primary Examiner* — Brian D Nash
(74) *Attorney, Agent, or Firm* — Maginot, Moore & Beck

(57) ABSTRACT

A pneumatic nailer for use with a high pressure fluid source is disclosed. The pneumatic nailer includes a housing defining a storage chamber positionable in fluid communication with the high pressure fluid source, a cylinder positioned within said housing, a piston having a piston head, said piston head being movable within said cylinder, said cylinder and said piston head defining a return chamber on side of said piston head, a sleeve movable with respect to said cylinder between a first sleeve position and a second sleeve position, said sleeve and said cylinder defining a sleeve space therebetween, wherein, when said sleeve is positioned in said first sleeve position, said sleeve space is isolated from fluid communication with said return chamber, and wherein, when said sleeve is positioned in said second sleeve position, said sleeve space is positioned in fluid communication with said return chamber.

16 Claims, 5 Drawing Sheets

PNEUMATIC NAILER WITH SLEEVE ACTUATED PISTON RETURN

FIELD

The present invention generally relates to pneumatic tools and more particularly to a pneumatic nailer.

BACKGROUND

Pneumatic tools are commonly used in the construction industry. In particular, pneumatic nailers are regularly used in roofing and framing projects. In a standard setting, a pneumatic nailer is coupled to a source of high pressure air, e.g., a portable compressor, to supply the pneumatic nailer with a source of pressure regulated compressed air. The pneumatic nailer is usually equipped with an elongated magazine that holds a plurality of nails. The nails are usually available in strips, whereby the nails are uniformly spaced apart from each other and are loosely connected to each other by a clip made from a thin layer of plastic or paper, or are simply connected to each other by a resin-type material. In another form, the nails are provided in a coil that is insertable into a round magazine. Once a worker at the construction site places a strip of nails into the magazine and couples the nailer to the high pressure source, the nailer is ready for operation.

The pneumatic nailer is equipped with an ejector assembly which includes a spring loaded safety tip. A nail from the strip of nails that is placed inside the magazine is internally situated adjacent to the tip of the ejector assembly. The operator places the tip of the ejector assembly against a workpiece to depress the tip. Once the tip is depressed, the nailer becomes responsive to force applied to a trigger. When force is applied to the trigger by the operator, the nailer activates a pneumatic actuating mechanism inside the nailer. The pneumatic actuating mechanism includes a ramming member which is plunged at a high velocity toward the nail from a ready position. The ramming member strikes the nail causing the nail to disengage from the strip of nails, exit through the ejector assembly, and drive into the workpiece. Once the operator releases the trigger, the pneumatic actuating mechanism quickly returns the ramming member to the ready position, and remains there until force is again applied to the trigger by the operator.

During the above operation, the nailers of the prior art provide compressed air to several chambers in order to activate the actuating mechanism as well as to return the actuating mechanism to its ready position. The compressed air is often released to atmosphere after it has performed its intended purpose, e.g., activate the actuating mechanism or return the ramming member. Therefore, several volumes of compressed air perform mechanical work in respective chambers, before being released to atmosphere. As a result, the compressed air leads to power cycling of the compressor, which not only uses power but also shortens the life of the compressor. In addition, some prior art nailers include return mechanisms which are relatively slow to return the ramming member to its ready position. This results in slower tool speed.

Therefore, there is a need for a pneumatic nailer that can recycle compressed air for performing some of its functions during activation of its actuating mechanism and returning the actuating mechanism to the ready position responsive to the worker pulling and releasing the trigger. There is also a need to improve the speed at which the ramming member is returned to the ready position, which would result in faster tool speed.

SUMMARY

In accordance with one embodiment of the present disclosure there is provided a pneumatic nailer for use with a high pressure fluid source. The pneumatic nailer includes a housing defining a storage chamber positionable in fluid communication with the high pressure fluid source, a cylinder positioned within said housing. The pneumatic nailer further includes a piston having a piston head and a driver member extending from said piston head, said piston head being movable within said cylinder, said cylinder and said piston head defining (i) a displacement chamber on a first side of said piston head, and (ii) a return chamber on an opposite second side of said piston head. The pneumatic nailer also includes a sleeve movable with respect to said cylinder between a first sleeve position and a second sleeve position, said sleeve and said cylinder defining a sleeve space therebetween, wherein, when said sleeve is positioned in said first sleeve position, (i) said sleeve space is isolated from fluid communication with said return chamber, and (ii) said return chamber is positioned in fluid communication with atmosphere, and wherein, when said sleeve is positioned in said second sleeve position, (i) said sleeve space is positioned in fluid communication with said return chamber via, and (ii) said return chamber is isolated from fluid communication with atmosphere. Furthermore, the pneumatic nailer includes a valve movable between (i) a first valve state in which said displacement chamber is isolated from fluid communication with said storage chamber and positioned in fluid communication with atmosphere, and (ii) a second valve state in which said displacement chamber is positioned in fluid communication with said storage chamber and isolated from fluid communication with atmosphere. The pneumatic nailer also includes an actuator positionable between an actuated position and a deactuated position, wherein (i) when said actuator is positioned in said actuated position, said valve is caused to move to said first valve state and said sleeve is caused to move to said first sleeve position, and (ii) when said actuator is positioned in said deactuated position, said valve is caused to move to said second valve state and said sleeve is caused to move to said second sleeve position.

BRIEF DESCRIPTION OF THE DRAWINGS

The above described features and advantages, as well as others, will become more readily apparent to those of ordinary skill in the art by reference to the following detailed description and accompanying drawings.

DETAILED DESCRIPTION

Figure 1:
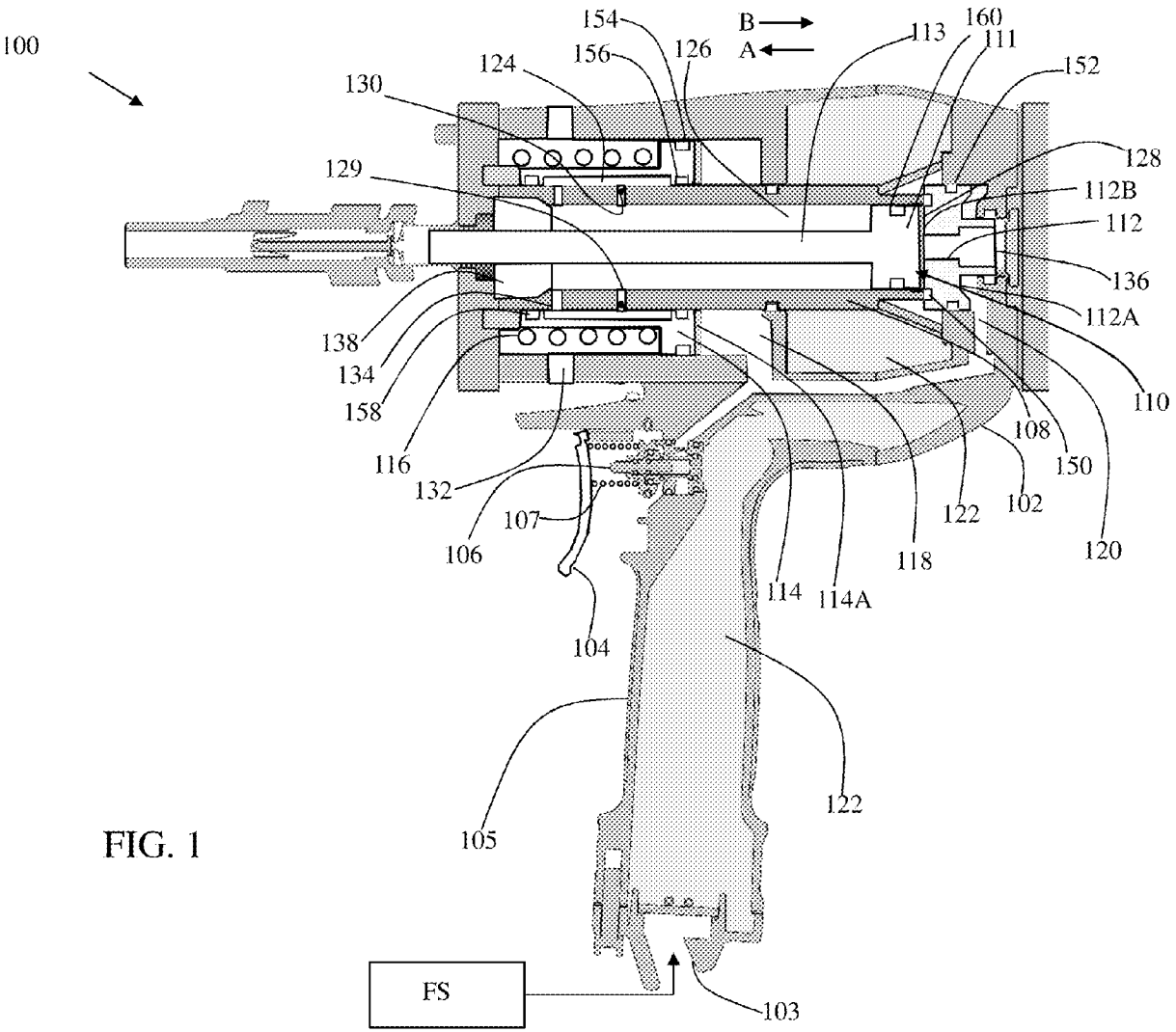
FIG. 1 depicts a cross sectional view of a pneumatic nailer of the present disclosure shown in a deactuated position.

For the purposes of promoting an understanding of the principles of the invention, reference will now be made to the embodiments illustrated in the drawings and described in the following written specification. It is understood that no limitation to the scope of the invention is thereby intended. It is further understood that the present invention includes any alterations and modifications to the illustrated embodiments and includes further applications of the principles of the invention as would normally occur to one of ordinary skill in the art to which this invention pertains.

Referring to FIG. 1, a pneumatic nailer 100 according to the present disclosure is depicted. The pneumatic nailer 100 includes a housing 102, a compressed air coupling member 103, a trigger 104, a trigger valve 106, a cylinder 108, a piston 110, a main valve 112, a sleeve 114, and a biasing member 116. The pneumatic nailer 100 also includes several chambers including a sleeve chamber 118, a main valve chamber 120, a storage chamber 122, a sleeve space 124, a return chamber 126, and a displacement chamber 128. The pneumatic nailer 100 also includes several air passages including fluid passages 129, vent ports 132, bidirectional ports 134, and a fluid passage 136. The pneumatic nailer 100 also includes a flexible bumper 138. The housing 102 includes a handle 105.

A high pressure fluid source FS, such as a portable air compressor, includes a coupling member (not shown) that cooperates with the coupling member 103 so as to place the high pressure fluid source FS in fluid communication with the pneumatic nailer 100. The compressed air coupling member 103 is disposed at an end of the handle 105 and is in continuous fluid communication with the storage chamber 122. The storage chamber 122 internally extends from a cavity in the handle 105 to a cavity adjacent to the cylinder 108. The trigger 104 is positionable in two positions. The first position is referred to as an actuated position and the second position is referred to as a deactuated position. The trigger valve 106 is also positionable in an actuated position and in a deactuated position. The trigger 104 is biased by a spring 107 to urge toward the deactuated position. Movement of the trigger 104 from its deactuated position to its actuated position causes the trigger valve 106 to move from its deactuated position to its actuated position.

The trigger valve 106 is in fluid communication with the sleeve chamber 118 and the main valve chamber 120. The sleeve chamber 118 and the main valve chamber 120 are in continuous fluid communication with each other. In the actuated position of the trigger valve 106, the trigger valve 106 is positioned to place the combination of sleeve chamber 118 and the main valve chamber 120 in fluid communication with atmosphere, i.e., allows fluid that is held in these chambers to escape to atmosphere thereby equalizing the pressure in these chambers with atmospheric pressure. In contrast, in the deactuated position, the trigger valve 106 is positioned to place the combination of sleeve chamber 118 and the main valve chamber 120 in fluid communication with the storage chamber 122. The piston 110 includes a piston head 111 and a drive member 113 that is coupled to the piston head 111. The main valve 112 includes the fluid passage 136 which is centrally located in the main valve 112. The main valve also includes sealing members 150 and 152.

The cylinder 108 is fixedly disposed inside the housing 102. The piston head 111 is moveably disposed inside the cylinder 108. The main valve 112 is moveably disposed inside a back portion of the housing 102. The sealing member 152 is disposed around the main valve 112 and seals the valve against the housing 102.

The main valve 112 is configured to move from a first position to a second position. In the first position, referred to as a deactuated position, the main valve 112 is in contact with the cylinder 108, and thereby seals the cylinder from fluid communication with the storage chamber 122 with the sealing member 150. The deactuated position of the main valve 112 is depicted in FIG. 1. The fluid passage 136 couples the piston side of the main valve 112 to atmosphere when the main valve 112 is in the deactuated position. The second position, referred to as an actuated position, is defined by the main valve 112 having moved out of contact with the cylinder 108 in a direction designated by an arrow B. In this position, the main valve 112 is positioned to place the cylinder in fluid communication with the storage chamber. Also, in the actuated position the fluid passage 136 is not in fluid communication with atmosphere.

The main valve 112 has two opposing activation surfaces 112A and 112B. The activation surface 112A is in continuous fluid communication with the main valve chamber 120. The activation surface 112B is in continuous fluid communication with the storage chamber 122. The activation surface 112A is larger in area than the activation surface 112B. When the main valve chamber 120 is in fluid communication with atmosphere, i.e., when the trigger valve 106 is in the actuated position, a negligible force is acting on the activation surface 112A. Meanwhile, a force $F_{112B}$, i.e., pressure inside the storage chamber multiplied by the area of the activation surface 112B, is acting on the activation surface 112B in a direction of the arrow B. The force $F_{112B}$ causes the main valve 112 to move in the direction of the arrow B. When the main valve chamber 120 is in fluid communication with the storage chamber 122, i.e., when the trigger valve 106 is in the deactuated position, a force $F_{112A}$, i.e., pressure inside the main valve chamber 120 multiplied by the area of the activation surface 112A, is acting on the activation surface 112A in the direction of an arrow A. The same force $F_{112B}$ is continuing to act on the activation surface 112B in the direction of the arrow B. However, since the activation surface 112A is larger than the activation surface 112B, the force $F_{112A}$ is also larger than the force $F_{112B}$. The difference between the two forces $F_{112A}$ and $F_{112B}$ results in a net force $F_{112N}$ with a magnitude of $F_{112A}$-$F_{112B}$ and a direction in the direction of the arrow A. Therefore, the net force $F_{112N}$ causes the main valve 112 to move in the direction of the arrow A.

In addition, a biasing member (not shown) is also disposed between the main valve 112 (contacting the activation surface 112A) and the end portion of the housing. The main valve biasing member is configured to provide an additional force $F_{112S}$ in the direction of the arrow A to add to the force $F_{112A}$. The force $F_{112S}$ is significantly smaller than the force $F_{112B}$, thereby the compressed air in the storage chamber can easily overcome the force $F_{112S}$ when the force $F_{112A}$ is negligible. In addition, the main valve biasing member biases the main valve 112 into contact with the cylinder to prevent rattling of the main valve 112 when there is no pressure applied to the pneumatic nailer 100, e.g., during shipping of the nailer.

The displacement chamber 128 is a space defined between the piston head 111 and the main valve 112. In FIG. 1, the displacement 128 has a negligible volume, i.e., the piston head 111 is positioned in close or actual contact with the main valve 112. The return chamber is a space defined below the piston head 111, i.e., between the piston head and the bumper 138. The bumper 138 is located at a distal end of the cylinder 108 and is configured to cushion and stop the high velocity moving piston head 111, described in greater detail below.

The sleeve 114 is moveably disposed outside of the cylinder 108 and is configured to form a sleeve space 124 between the sleeve 114 and the cylinder 108. The sleeve 114 includes sealing members 154, 156, and 158 to seal the sleeve chamber 118 from the sleeve space 124 as well as from the vent ports 132. The sleeve is biased in the direction of the arrow B by the biasing member 116. The sleeve 114 is configured to move from a first position to a second position.

In the first position, referred to as a deactuated position, the sleeve 114 is at a distal end of the housing 102. The deactuated position of the sleeve 114 is depicted in FIG. 1. In the deactuated position, the sleeve chamber 118 is in fluid communication with the storage chamber 122. The pressure of the sleeve chamber 118 acts on an activation surface 114A of the sleeve 114, thereby generating a force $F_{114A}$ which equals to the area of the activation surface 114 multiplied by the pressure in the sleeve chamber 118. The force $F_{114A}$ is larger than a biasing force $F_{114S}$ that is generated by the biasing member 116. Thus, a net force $F_{114N}$ is generated that causes movement of the sleeve in the direction of the arrow A to the deactuated position. In the deactuated position, the sleeve space 124 is in fluid communication with the return chamber 126 via the bidirectional ports 134.

The second position, referred to as an actuated position, is defined by the sleeve 114 after it is moved in the direction of the arrow B. In the actuated position, the sleeve chamber 118 is no longer in fluid communication with the storage chamber 122. Instead, the sleeve chamber 118 is in fluid communication with atmosphere. The biasing force $F_{114S}$ is larger than the Force $F_{114A}$, which is negligible in the actuated position. Therefore, the sleeve 114 moves from its deactuated position to its actuated position in the direction of the arrow B. In the actuated position, the sleeve space 124 is in fluid communication with the displacement chamber 128 via check valves 130, as discussed below in more detail.

In operation, the main valve biasing member (not shown) biases the main valve 112 against the cylinder 108. An operator couples the pneumatic nailer 100 to a high pressure source, e.g., a compressor, by connecting the compressed air coupling member 103 to the coupling member (not shown) of the high pressure fluid source FS. So coupled, compressed air advances into the storage chamber 122. With the trigger 104 being in the deactuated position, the trigger valve 106 is positioned to place the main valve chamber 120 in fluid communication with the storage chamber 122. The pressure in the main valve chamber 120 generates the force $F_{112A}$ on the activation surface 112A of the main valve 112. Also, the pressure in the storage chamber 122 generates the force $F_{112B}$ on the activation surface 112A of the main valve 112. The force $F_{112A}$ and the force $F_{112S}$, i.e., the force generated by the main valve biasing member (not shown), counteract the force $F_{112B}$ to generate the net force $F_{112N}$ which causes the main valve 112 to forcefully remain against the cylinder 108.

Also, with the trigger being in the deactuated position, the trigger valve 106 is positioned to place the sleeve chamber 118 in fluid communication with the storage chamber 122. The pressure in the sleeve chamber 118 generates the force $F_{114A}$ on the activation surface 114A of the sleeve 114. The force $F_{114A}$ counteracts the force $F_{114S}$ to generate the net force $F_{114N}$ which causes the sleeve 114 to assume the position shown in FIG. 1.

Figure 2:
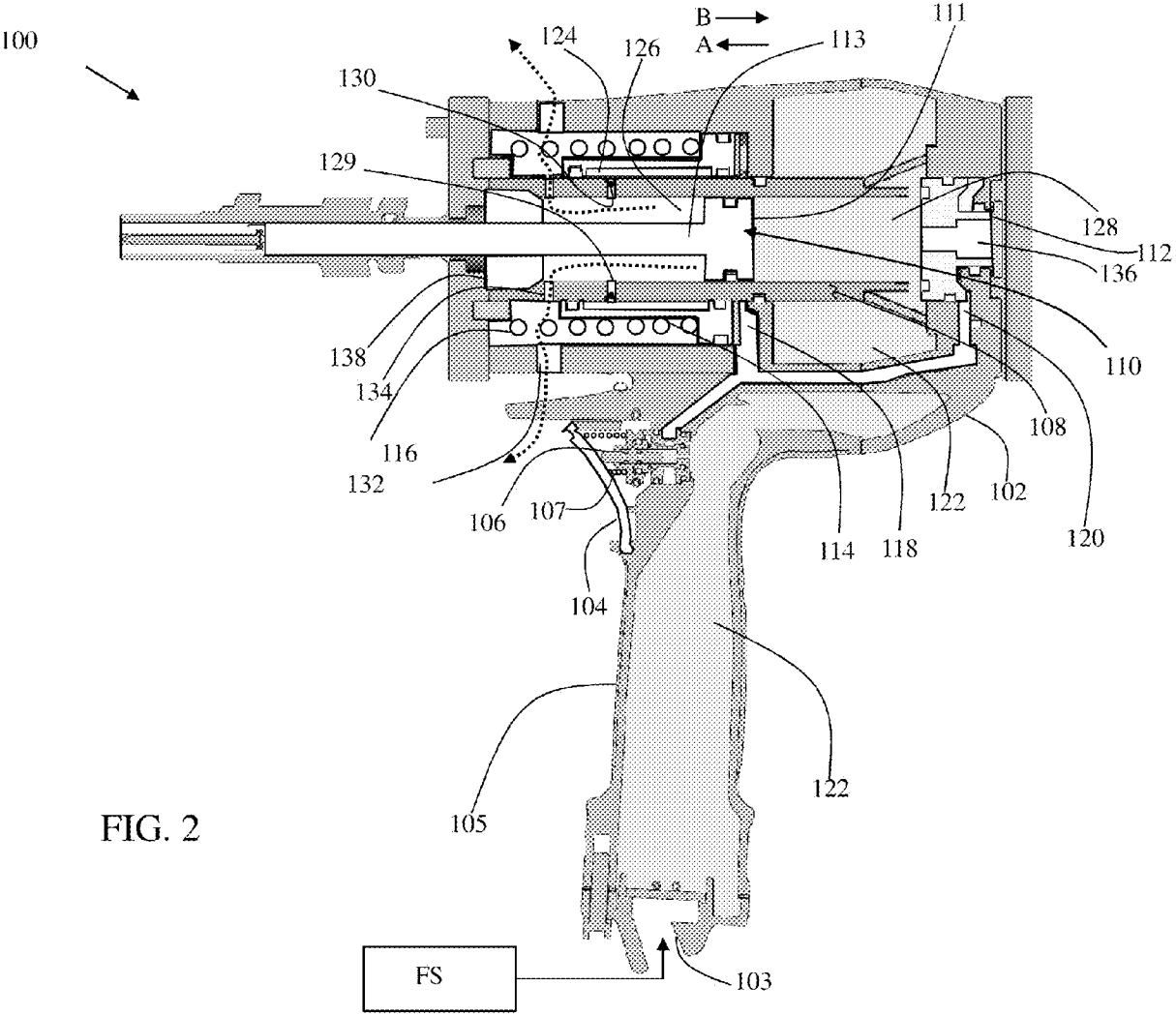
FIG. 2 is a view similar to FIG. 1, but showing the pneumatic nailer in a transitional state immediately after the pneumatic nailer has been placed in an actuated position.

The operator then presses on the trigger 104 to move it to the actuated position. FIG. 2 depicts the pneumatic nailer 100 in a transitional state immediately after the trigger 104 has been placed in the actuated position. With the trigger 104 being in the actuated position, the trigger valve 106 is positioned to place the main valve chamber 120 in fluid communication with atmosphere. The force $F_{112A}$ on the activation surface 112A of the main valve 112 is thereby negligible. The pressure in the storage chamber 122 continues to generate the force $F_{112B}$ on the activation surface 112B of the main valve 112. The force $F_{112S}$ counteracts the force $F_{112B}$ to generate the net force $F_{112N}$ which causes the main valve 112 to move in the direction of the arrow B, thereby unsealing from the cylinder 108, as depicted in FIG. 2.

Once the main valve 112 no longer seals the cylinder 108 from the storage chamber 122, high pressure fluid from the storage chamber 122 is advanced into the displacement chamber 128. In turn, the piston 110 moves in the direction of the arrow A.

With the trigger being in the actuated position, the trigger valve 106 is positioned to place the sleeve chamber 118 also in fluid communication with atmosphere. Thereafter, the force $F_{114A}$ on the activation surface 114A of the sleeve 114 is negligible. The essentially unimpeded force $F_{114S}$ causes the sleeve 114 to move in the direction of the arrow B to its actuated position, as shown in FIG. 2.

In the actuated position of the sleeve 114, the bidirectional ports 134 are in fluid communication with atmosphere via the vent ports 132. It should be appreciated that while two vent ports 132 and two bidirectional ports 134 are depicted in the figures of the present disclosure, additional bidirectional ports and vent ports can be provided to improve fluid communication.

With the bidirectional ports 134 being in fluid communication with atmosphere via the vent ports 132, the fluid present in the return chamber 126 is exhausted to atmosphere, as the piston 110 moves in the direction of the arrow A. The fluid transfer between the return chamber 126 and atmosphere is indicated by dotted arrows showing the direction of flow of the fluid. Since the return chamber 126 is in fluid communication with atmosphere, the piston 110 moves in an essentially unimpeded manner thereby improving the operational efficiency of the pneumatic nailer 100.

Also depicted in FIG. 2, is the impact of the nail by the drive member 113 of the piston 110. The piston 110 moves at a high rate of speed in the direction of the arrow A. Upon impacting the nail, the nail is driven out of the pneumatic nailer at a high rate of speed. While not shown, it should be appreciated that the pneumatic nailer 100 is equipped with standard safety features available on pneumatic nailers of the prior art. For example, the nail is located inside an ejector that includes a moveambletip. The trigger is locked in the deactuated position, until the tip of the ejector has been urged against a workpiece so as to be in a depressed state.

Figure 3:
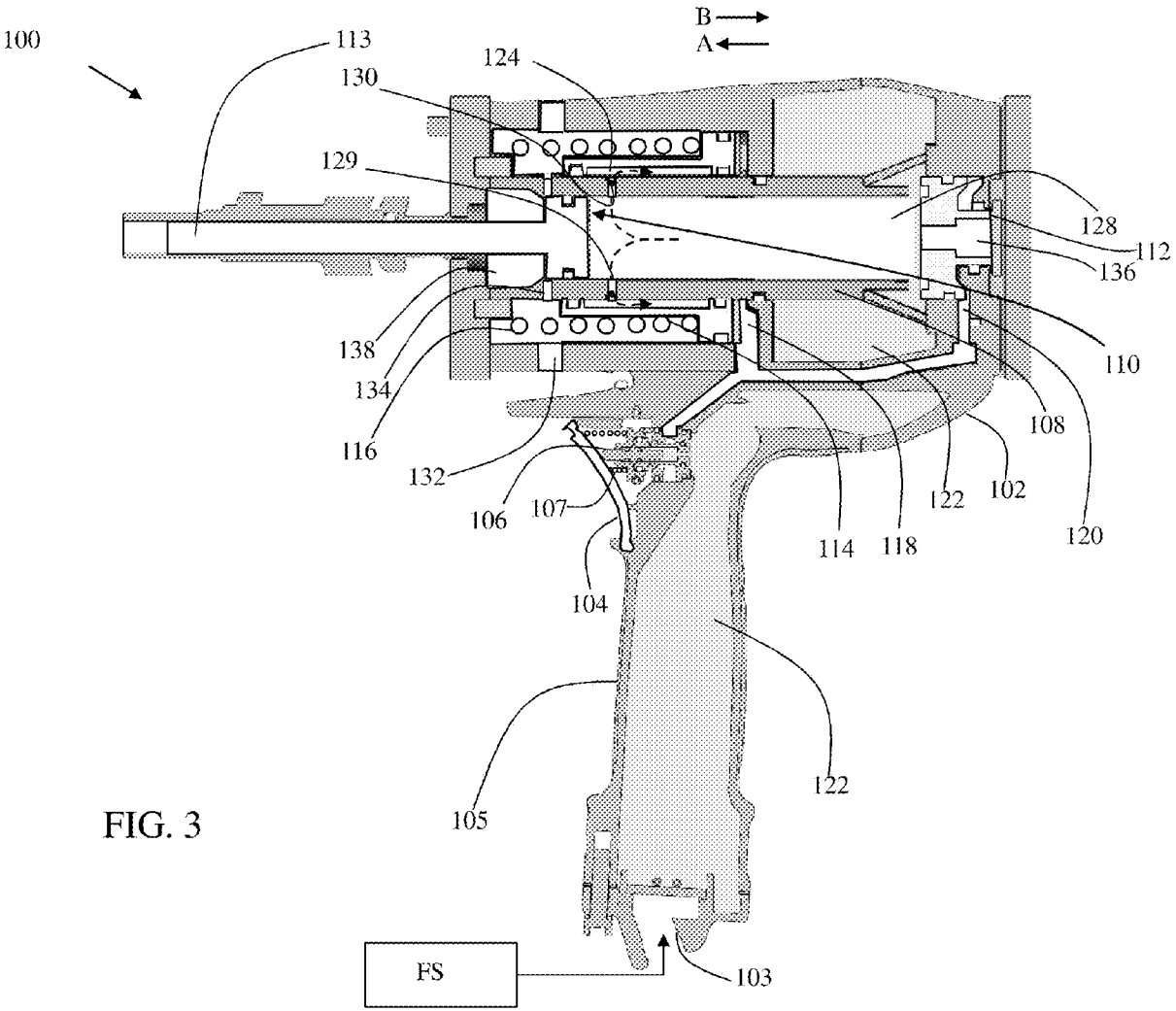
FIG. 3 is a view similar to FIG. 2, but showing the pneumatic nailer in a steady-state of the actuated position.

With the trigger in the actuated position, the piston 110 continues to move in the direction of the arrow A from its position shown in FIG. 2 until the piston 110 comes in contact with the bumper 138. FIG. 3 depicts the pneumatic nailer 100 in a steady-state after the trigger 104 has been placed in the actuated position. In FIG. 3, the piston 110 is in contact with the bumper 138. The bumper 138 is resilient and thus provides a shock absorber function for the piston 110. In addition, the bumper 138 prevents a metal-to-metal contact between the piston head 111 and the distal end of the cylinder 108. The high pressure fluid in the displacement chamber 128 advantageously minimizes bouncing of the piston 110 off of the bumper 138. Also depicted in FIG. 3 is the complete ejection of the nail out of the pneumatic nailer 100. The pneumatic nailer remains in the steady-state that is depicted in FIG. 3, until the operator of the pneumatic nailer releases the trigger 104, so that the trigger moves from the actuated position to the deactuated position.

Also depicted in FIG. 3, is a one-directional fluid flow between the displacement chamber 128 and the sleeve space 124, via the fluid passages 129 defined in a wall of the cylinder 108 and the check valves 130, according to the direction of the dashed arrows. Such fluid flow causes the sleeve space to be charged so as to assume a high pressure condition. This fluid transfer occurs only after a sealing member 160 of the piston head 111 has cleared the check valves 130 in its path of travel.

Figure 4:
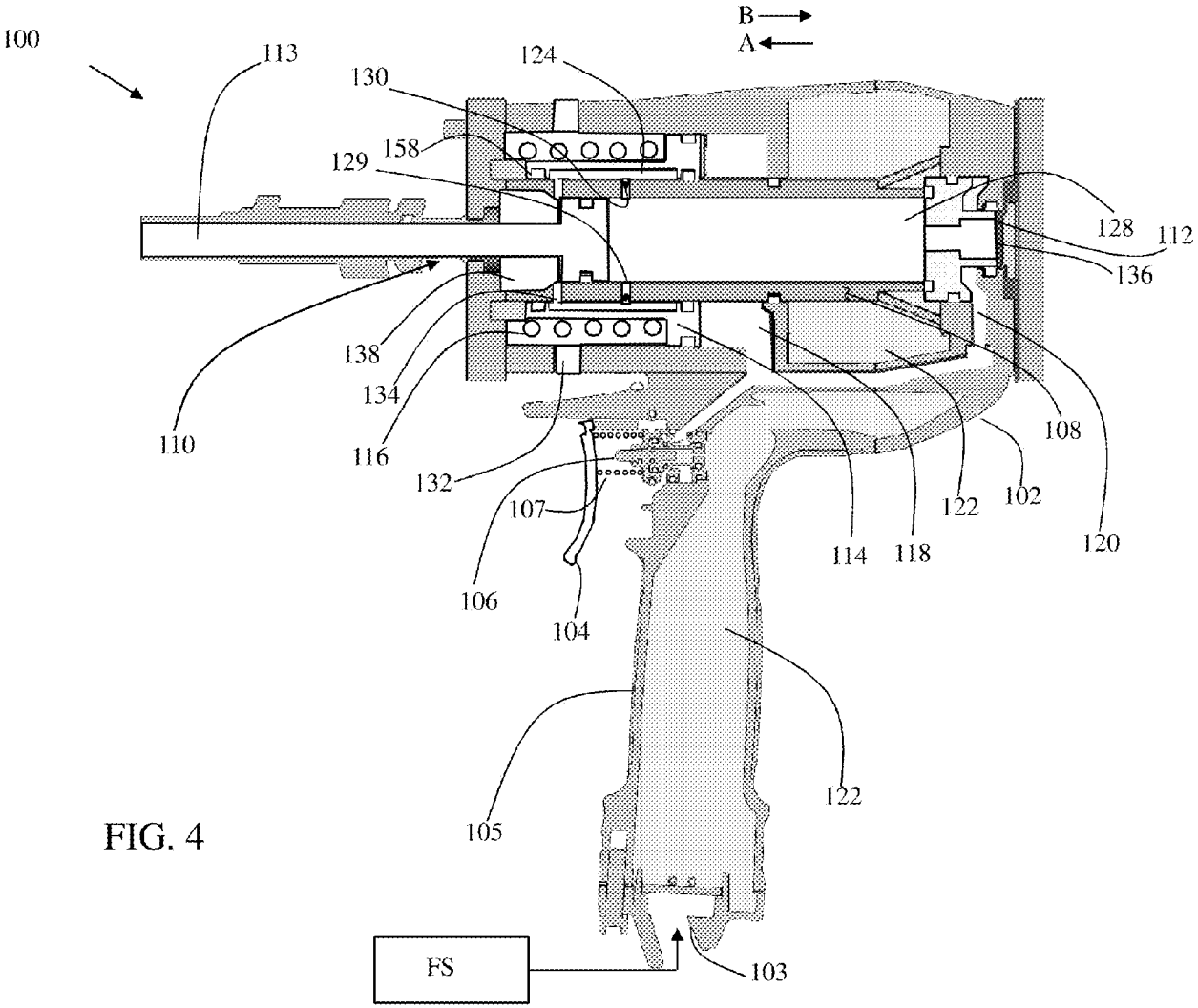
FIG. 4 is a view similar to FIG. 3, but showing the pneumatic nailer in an initial transitional state immediately after the pneumatic nailer has been placed in the deactuated position after having been in the actuated position.

FIG. 4 depicts the pneumatic nailer 100 in an initial transitional state immediately after the trigger 104 has been placed in the deactuated position after having been in the actuated position. With the trigger 104 being in the deactuated position, the trigger valve 106 is positioned to place the main valve chamber 120 in fluid communication with the storage chamber 122. The force $F_{112A}$ on the activation surface 112A added to the force $F_{112S}$ from the main valve biasing member counteract the force $F_{112B}$ applied to the activation surface 112B by the pressure in the storage chamber 122, to generate the net force $F_{112N}$ which causes the main valve 112 to move in the direction of the arrow A, thereby sealing the cylinder 108 from the storage chamber 122, as depicted in FIG. 4.

Once the main valve 112 seals the cylinder 108 from the storage chamber 122, the displacement chamber 128 is placed in fluid communication with atmosphere via the fluid passage 136 located centrally in the main valve 112. In other words, with the main valve 112 placed in the position depicted in FIG. 4, i.e., against the cylinder 108, the fluid passage 136 opens to atmosphere.

With the trigger placed in the deactuated position, the trigger valve 106 is positioned to place the sleeve chamber 118 also in fluid communication with the storage chamber 122. Therefore, the force $F_{114A}$ on the activation surface 114A of the sleeve 114 overcomes the force $F_{114S}$ and causes the sleeve to move in the direction of the arrow A, to its position depicted in FIG. 4.

In the deactuated position of the sleeve 114, the bidirectional ports 134 are in fluid communication with the sleeve space 124. Therefore, the return chamber 126, depicted as collapsed in FIG. 4, is placed in fluid communication with the sleeve space 124 via the bidirectional ports 134. The sealing member 158 prevents fluid communication of the sleeve space 124 or the return chamber 126 with atmosphere via the vent ports 132.

With the return chamber 126 being in fluid communication with the sleeve space 124, and with the displacement chamber 128 being in fluid communication with atmosphere via the fluid passage 136, the high pressure fluid present in the sleeve space 124 causes the piston to move in the direction of the arrow B.

Figure 5:
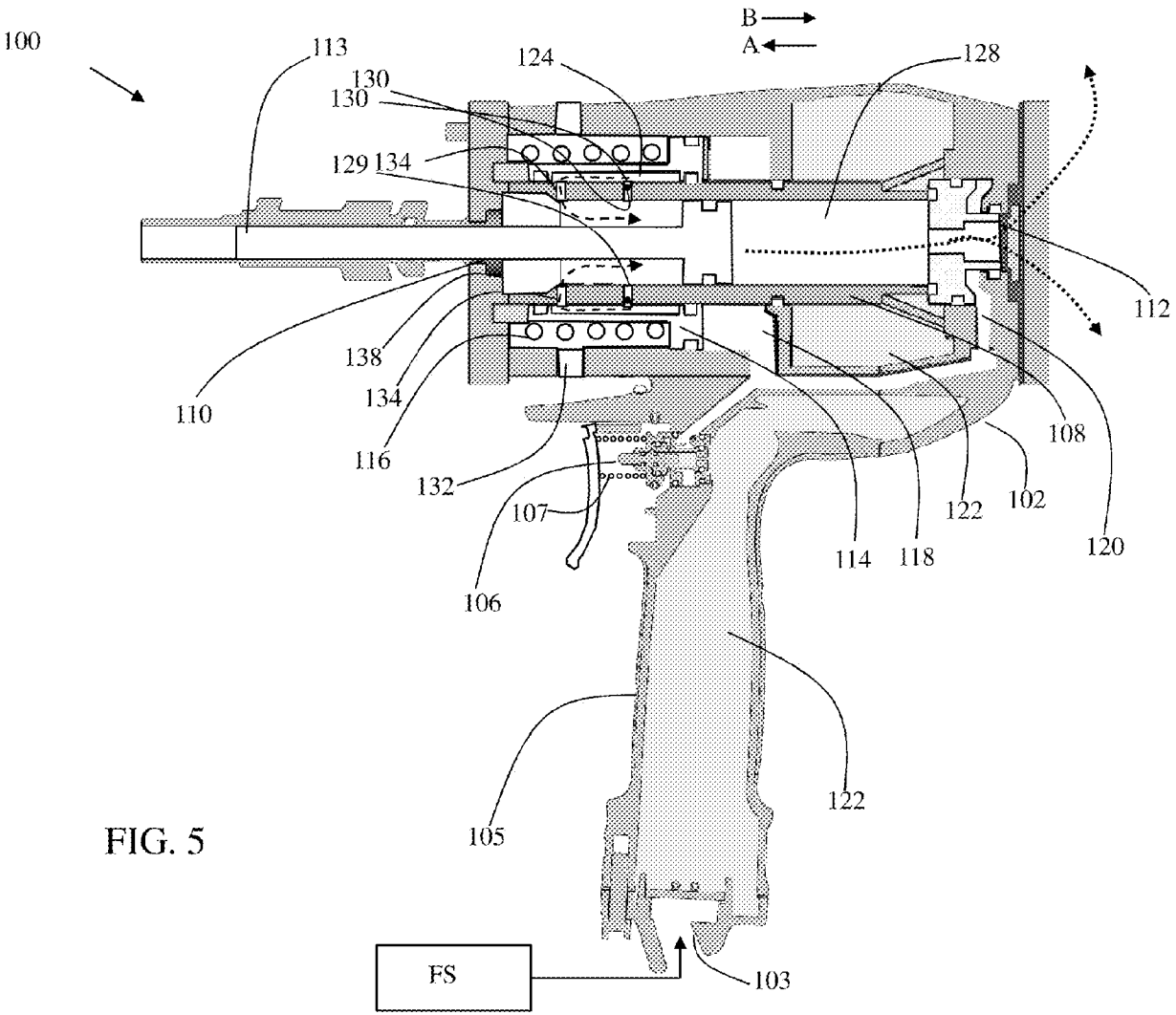
FIG. 5 is a view similar to FIG. 4, but showing the pneumatic nailer in another transitional state at a short time after the pneumatic nailer has been placed in the deactuated position after having been in the actuated position.

FIG. 5 depicts the pneumatic nailer 100 in another transitional state at a short time after the trigger has been placed in the deactuated position after having been in the actuated position. Depicted in FIG. 5 are two sets of arrows indicating flow of fluid. The first set of arrows, dashed arrows, indicate fluid transfer from the sleeve space 124 into the return chamber 126. The fluid in the sleeve space 124 has a high pressure, since high pressure fluid was introduced into the sleeve space 124 from the displacement chamber 128 through the fluid passages 129 and the check valves 130 during the latter part of the piston movement that was depicted in FIG. 3. The high pressure fluid introduced into the return chamber 126 acts on the lower side of the piston head 111 and thereby causes the piston 110 to move in the direction of the arrow B. The second set of arrows, the dotted arrows, indicate fluid flow from the displacement chamber 128 to atmosphere via the fluid passage 136 of the main valve 112.

While the invention has been illustrated and described in detail in the drawings and foregoing description, the same should be considered as illustrative and not restrictive in character. It is understood that only the preferred embodiments have been presented and that all changes, modifications and further applications that come within the spirit of the invention are desired to be protected.

What is claimed is:

1. A pneumatic nailer for use with a high pressure fluid source, comprising:

a housing defining a storage chamber positionable in fluid communication with the high pressure fluid source;

a cylinder positioned within said housing;

a piston having a piston head and a driver member extending from said piston head, said piston head being movable within said cylinder, said cylinder and said piston head defining (i) a displacement chamber on a first side of said piston head, and (ii) a return chamber on an opposite second side of said piston head;

a sleeve movable with respect to said cylinder between a first sleeve position and a second sleeve position, said sleeve and said cylinder defining a sleeve space therebetween, wherein, when said sleeve is positioned in said first sleeve position, (i) said sleeve space is isolated from fluid communication with said return chamber, and (ii) said return chamber is positioned in fluid communication with atmosphere, and wherein, when said sleeve is positioned in said second sleeve position, (i) said sleeve space is positioned in fluid communication with said return chamber, and (ii) said return chamber is isolated from fluid communication with atmosphere;

a valve movable between (i) a first valve state in which said displacement chamber is isolated from fluid communication with said storage chamber and is positioned in fluid communication with atmosphere, and (ii) a second valve state in which said displacement chamber is positioned in fluid communication with said storage chamber and is isolated from fluid communication with atmosphere; and an actuator positionable between an actuated position and a deactuated position, wherein (i) when said actuator is positioned in said actuated position, said valve is caused to move to said first valve state and said sleeve is caused to move to said first sleeve position, and (ii) when said actuator is positioned in said deactuated position, said valve is caused to move to said second valve state and said sleeve is caused to move to said second sleeve position.

2. The pneumatic nailer of claim 1, wherein:

said cylinder includes a side wall having defined therein a first fluid passage and a second fluid passage, and when said sleeve is positioned in said second sleeve position, said displacement chamber is positioned in fluid communication with said return chamber via said first fluid passage, said sleeve space, and said second fluid passage.

3. The pneumatic nailer of claim 2, further comprising a check valve configured to (i) allow fluid flow from said displacement chamber to said sleeve space via said first passage, and (ii) prevent fluid flow from said sleeve space to said displacement chamber via said first passage.

4. The pneumatic nailer of claim 2, wherein:

said housing including an exterior wall that defines a vent passage, and when said sleeve is positioned in said first sleeve position, said return chamber is positioned in fluid communication with atmosphere via said second fluid passage and said vent passage.

5. The pneumatic nailer of claim 1, further comprising a spring located in said housing and configured to bias said sleeve toward said first sleeve position.

6. The pneumatic nailer of claim 5, wherein:

said housing further defines an end wall, and said spring is interposed between said end wall and said sleeve.

7. The pneumatic nailer of claim 6, further comprising a bumper, wherein:

said housing further has a recess defined in said end wall, said bumper is at least partially located in said recess, and said spring is positioned around said sleeve, said cylinder, and said bumper.

8. The pneumatic nailer of claim 1, further comprising a bumper located at least partially within said housing, wherein:

said bumper defines a driver passage, and said driver member extends through said driver passage.

9. The pneumatic nailer of claim 8, wherein said return chamber is interposed between said bumper and said piston head.

10. The pneumatic nailer of claim 1, wherein:

said cylinder includes a first end portion and an opposite second end portion, said valve is coupled to said first end portion of said cylinder, said displacement chamber is interposed between said valve and said piston head.

11. The pneumatic nailer of claim 10, further comprising a bumper coupled to said second end portion of said cylinder, wherein:

said return chamber is interposed between said bumper and said piston head.

12. The pneumatic nailer of claim 1, wherein:

said housing further defines a control passage, when said actuator is positioned in said deactuated position, said control passage is in fluid communication with said storage chamber, and when said control passage is in fluid communication with said storage chamber, said valve is positioned in said first valve state.

13. The pneumatic nailer of claim 12, wherein:

said housing further defines a sleeve chamber in which said sleeve is located, said sleeve chamber is in fluid communication with said control passage, and when said control passage is in fluid communication with said storage chamber, said sleeve is positioned in said second sleeve position.

14. The pneumatic nailer of claim 12, wherein:

when said actuator is positioned in said actuated position, said control passage is isolated from fluid communication with said storage chamber, and when control passage is isolated from fluid communication with said storage chamber, said valve is positioned in said second valve state.

15. The pneumatic nailer of claim 14, wherein:

said housing further defines a sleeve chamber in which said sleeve is located, said sleeve chamber is in fluid communication with said control passage, when said control passage is in fluid communication with said storage chamber, said sleeve is positioned in said second sleeve position, and when control passage is isolated from fluid communication with said storage chamber, said sleeve is positioned in said first sleeve position.

16. The pneumatic nailer of claim 15, wherein:

when said actuator is positioned in said actuated position, said control passage is in fluid communication with atmosphere.

* * * * *